US007651321B2

(12) United States Patent
Ota et al.

(10) Patent No.: US 7,651,321 B2
(45) Date of Patent: Jan. 26, 2010

(54) VARIABLE DISPLACEMENT COMPRESSOR

(75) Inventors: Masaki Ota, Kariya (JP); Osamu Nakayama, Kariya (JP); Akinobu Kanai, Kariya (JP); Akihito Yamanouchi, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 369 days.

(21) Appl. No.: 11/341,042

(22) Filed: Jan. 26, 2006

(65) Prior Publication Data

US 2006/0165535 A1 Jul. 27, 2006

(30) Foreign Application Priority Data

Jan. 27, 2005 (JP) ..... 2005-020145

(51) Int. Cl.
*F04B 1/32* (2006.01)
*F04B 49/22* (2006.01)

(52) U.S. Cl. ..... 417/222.2; 417/295; 417/441

(58) Field of Classification Search ..... 417/441, 417/295, 222.2
See application file for complete search history.

(56) References Cited

U.S. PATENT DOCUMENTS

| | | | | |
|---|---|---|---|---|
| 4,669,272 | A | 6/1987 | Kawai et al. | 62/228.3 |
| 4,688,997 | A * | 8/1987 | Suzuki et al. | 417/222.2 |
| 4,702,677 | A | 10/1987 | Takenaka et al. | 417/222 |
| 5,584,670 | A * | 12/1996 | Kawaguchi et al. | 417/222.2 |
| 5,636,973 | A * | 6/1997 | Sonobe et al. | 417/222.2 |
| 6,045,337 | A | 4/2000 | Tokumasu | |
| 6,257,848 | B1 | 7/2001 | Terauchi | 417/441 |
| 6,520,751 | B2 | 2/2003 | Fujita et al. | 417/295 |
| 6,561,482 | B2 | 5/2003 | Okii | |
| 2005/0244279 | A1 * | 11/2005 | Murakami et al. | 417/222.2 |

FOREIGN PATENT DOCUMENTS

| | | |
|---|---|---|
| EP | 0 845 593 | 6/1998 |

(Continued)

OTHER PUBLICATIONS

Korean Notice of Allowance dated Jul. 30, 2007, received in corresponding Korean Patent Application No. 2006-0008433 without English translation.

*Primary Examiner*—Devon C Kramer
*Assistant Examiner*—Philip Stimpert
(74) *Attorney, Agent, or Firm*—Locke Lord Bissell & Liddell LLP

(57) ABSTRACT

Refrigerant gas is introduced into a suction chamber through a suction line. Refrigerant gas is allowed to flow from the crank chamber into the suction chamber through an outlet line. An open degree adjustment valve (34) has a first valve body for adjusting an open degree of the suction line and a second valve body for adjusting an open degree of the outlet line. The first valve body and the second valve body are connected to each other. The first valve body moves in such a manner as to increase the open degree of the suction line when the difference between the pressure in the suction chamber and the pressure in the crank chamber decreases, and reduce the open degree of the suction line when the difference between the pressure in the suction chamber and the pressure in the crank chamber increases. Thus, variation of gas pressure is reliably suppressed while maintaining favorable starting performance of the compressor.

5 Claims, 2 Drawing Sheets

FOREIGN PATENT DOCUMENTS

| | | |
|---|---|---|
| EP | 0 881 387 | 12/1998 |
| EP | 0 855 506 | 11/2001 |
| EP | 1 363 021 | 11/2003 |
| JP | 2000-136776 | 5/2000 |
| JP | 2003-074728 | 3/2003 |
| KR | 20020030717 | 4/2002 |

* cited by examiner

VARIABLE DISPLACEMENT COMPRESSOR

BACKGROUND OF THE INVENTION

The present invention relates to variable displacement compressors that vary the stroke of a piston accommodated in a cylinder bore by adjusting the pressure in a crank chamber.

A variable displacement compressor allows a piston to reciprocate in a cylinder bore through rotation of a drive shaft. This compresses the gas in a compression chamber and thus discharges the gas from the compression chamber. The displacement of the compressor is varied by varying the stroke of the piston. When the gas flow rate of the compressor is relatively low, the amount of the gas passing through a suction valve correspondingly decreases. This may cause self-induced oscillation of the suction valve in a free oscillation area in which the suction valve is prevented from contacting a stopper. Such oscillation of the suction valve may vary the pressure of the gas. The pressure variation of the gas then transmits to an evaporator of an external refrigerant circuit connected to the compressor, thus generating noise.

To solve this problem, Japanese Laid-Open Patent Publication No. 2000-136776 describes a compressor that has an open degree control valve that controls the communication area of a suction line. This structure suppresses the pressure variation of gas when the gas flow rate is relatively low.

However, actuation of the open degree control valve is based on a pressure difference caused by the flow of gas in the suction line. The pressure difference becomes smaller as the gas flow rate becomes lower. This may destabilize the operation of the open degree control valve, making it difficult to suppress the pressure variation of the gas.

Also, the compressor includes a supply line that connects a crank chamber to a discharge chamber and an outlet line that connects the crank chamber to a suction chamber. The compressor controls the pressure in the crank chamber by adjusting the amount of the gas passing through each of the supply and outlet lines. The displacement of the compressor is thus controlled. The open degree of the supply passage is adjusted to bring about a rapid change of the displacement. Further, a fixed orifice is provided in a bleed passage and thus reduces the short-circuit amount (the leak amount) of the compressed gas from the crank chamber to the suction chamber. Therefore, when the compressor is being started, drainage of liquid refrigerant from the crank chamber occurs only slowly due to the fixed orifice provided in the outlet line. This may lead to evaporation of an excessive amount of liquid refrigerant in the crank chamber. The pressure in the crank chamber thus rises excessively. As a result, the displacement of the compressor reaches a sufficiently high level only with a relatively long delay, hampering the starting performance of the compressor.

SUMMARY OF THE INVENTION

Accordingly, it is an objective of the present invention to provide a variable displacement compressor that reliably suppresses variation of gas pressure when varying the displacement, while maintaining favorable starting performance of the compressor.

To achieve the above-mentioned objective, the present invention provides a variable displacement compressor having a piston accommodated in a cylinder bore. The piston operates to draw from a suction chamber into the cylinder bore refrigerant gas that has been introduced into the suction chamber through a suction line. The piston compresses the refrigerant gas in the cylinder bore and discharges the refrigerant gas into a discharge chamber. The refrigerant gas is allowed to flow from the discharge chamber into a crank chamber through a supply passage, and from the crank chamber into the suction chamber through an outlet line for adjusting the pressure in the crank chamber. A stroke of the piston changes in correspondence with the pressure in the crank chamber. The compressor includes an open degree adjustment valve, which has a first valve body for adjusting an open degree of the suction line, a second valve body for adjusting an open degree of the outlet line, and a valve chamber accommodating the first valve body and the second valve body. The first valve body and the second valve body are connected to each other movably in the valve chamber in correspondence with a pressure in the suction chamber and the pressure in the crank chamber. The first valve body moves in such a manner as to increase the open degree of the suction line when the difference between the pressure in the suction chamber and the pressure in the crank chamber decreases, and reduce the open degree of the suction line when the difference between the pressure in the suction chamber and the pressure in the crank chamber increases. The second valve body moves in such a manner as to increase the open degree of the outlet line when the difference between the pressure in the suction chamber and the pressure in the crank chamber decreases, and reduce the open degree of the outlet line when the difference between the pressure in the suction chamber and the pressure in the crank chamber increases.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages there of, may best be understood by reference to the following description of the presently preferred embodiments together with the accompanying drawings in which:

FIG. 1 is being started and operating at a maximum displacement.

DETAILED DESCRIPTION OF THE PREFERRED EMBODIMENTS

A clutch less type variable displacement compressor according to an embodiment of the present invention will now be described with reference to FIGS. 1 to 3.

Figure 1:
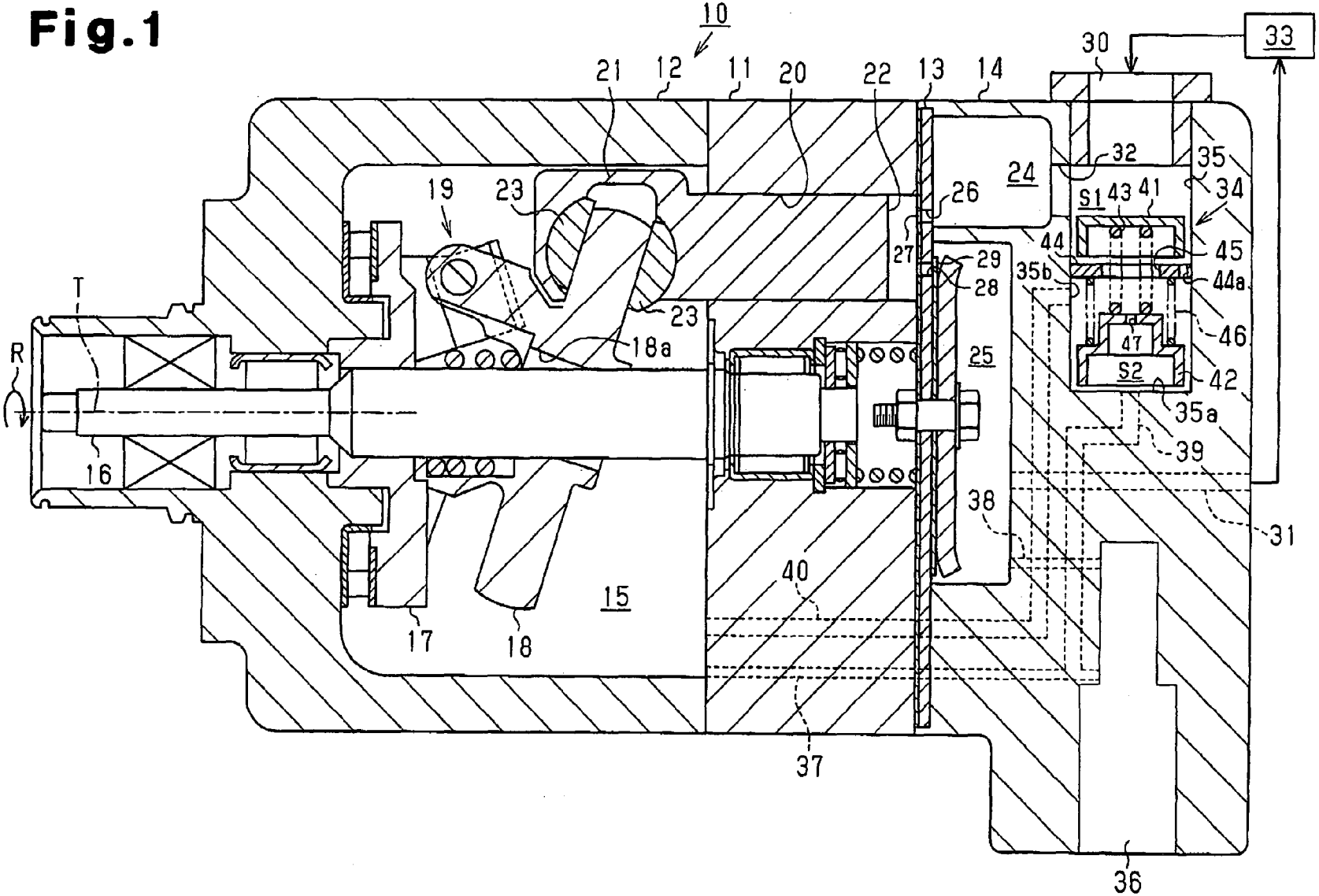
FIG. 1 is a cross-sectional view showing a variable displacement compressor according to an embodiment of the present invention.

FIG. 1 is a longitudinal cross-sectional view showing a compressor 10 of the illustrated embodiment. A front portion of the compressor 10 is illustrated in a left part of FIG. 1 and a rear portion of the compressor 10 is illustrated in a right part of the drawing. As shown in FIG. 1, the compressor 10 includes a cylinder block 11, a front housing member 12, a valve housing member 13, and a rear housing member 14. The front housing member 12 is securely joined with the front end of the cylinder block 11. The rear housing member 14 is securely joined with the rear end of the cylinder block 11. The valve housing member 13 is arranged between the cylinder block 11 and the rear housing member 14. The housing of the compressor 10 is defined by the cylinder block 11, the front housing member 12 and the rear housing member 14.

A crank chamber 15 is defined by the cylinder block 11 and the front housing member 12. A drive shaft 16 is rotatably supported by the cylinder block 11 and the front housing member 12 and extends through the crank chamber 15. A non-illustrated rotational drive source such as an engine or a motor, which is a drive source of a vehicle, is connected to the drive shaft 16. As powered by the rotational drive source, the drive shaft 16 rotates in a direction indicated by arrow R.

A lug plate 17 is secured to the drive shaft 16 in the crank chamber 15. The crank chamber 15 accommodates a swash plate 18. A through hole 18*a* extends through the center of the swash plate 18. The drive shaft 16 is passed through the through hole 18*a*. A hinge mechanism 19 is arranged between the lug plate 17 and the swash plate 18. The swash plate 18 is thus connected to the lug plate 17 through the hinge mechanism 19 and supported by the drive shaft 16, which is received in the through hole 18*a*. This structure allows the swash plate 18 to rotate integrally with the drive shaft 16 and the lug plate 17. Also, the swash plate 18 is allowed to incline with respect to the drive shaft 16 while sliding along the drive shaft 16 in a direction defined by the axis T of the drive shaft 16.

The cylinder block 11 has a plurality of cylinder bores 20 (only one is shown in FIG. 1) that are defined about the axis T of the drive shaft 16 at equal angular intervals. Each of the cylinder bores 20 extends in a front-rear direction of the compressor 10. A single-headed piston 21 is accommodated in each cylinder bore 20 and thus allowed to reciprocate in the front-rear direction. A front opening and a rear opening of each cylinder bore 20 are closed by a front end surface of the valve housing member 13 and the piston 21, respectively. A compression chamber 22 is defined in each cylinder bore 20. The volume of each compression chamber 22 is changed through reciprocation of the corresponding piston 21. Each piston 21 is engaged with an outer circumferential portion of the swash plate 18 through a pair of shoes 23.

A suction chamber 24 and a discharge chamber 25 are defined in the rear housing member 14 to face the valve housing member 13. A suction hole 26 and a suction valve 27 are provided in the valve housing member 13 and between each compression chamber 22 and the suction chamber 24. Also, a discharge hole 28 and a discharge valve 29 are provided in the valve housing member 13 and between the compression chamber 22 and the discharge chamber 25.

Further, a suction port 30 and a discharge port 31 are defined in the rear housing member 14. The suction chamber 24 is connected to an external refrigerant circuit 33 through a gas passage 32 and the suction port 30. The suction chamber 24 draws return gas (low-pressure refrigerant gas) from an evaporator (not shown) arranged in the external refrigerant circuit 33. The gas passage 32 is provided in the rear housing member 14 and thus connects the suction chamber 24 to the suction port 30. The communication area of the gas passage 32 is sufficiently large for ensuring a gas flow rate corresponding to a maximum displacement state of the compressor 10. The "maximum displacement state" is defined as a running state of the compressor 10 in which the displacement is maximum. In the illustrated embodiment, the suction port 30 and the gas passage 32 define a suction line through which refrigerant gas is drawn from the external refrigerant circuit 33 to the suction chamber 24. The discharge chamber 25 is connected to the external refrigerant circuit 33 through the discharge port 31. The discharge chamber 25 thus supplies high-pressure refrigerant gas to a condenser (not shown) arranged in the external refrigerant circuit 33. The external refrigerant circuit 33 includes a depressurization device (not shown), as well as the condenser and the evaporator.

In the rear housing member 14, a valve chamber 35 of an open degree adjustment valve 34 is defined between the suction port 30 and the gas passage 32. The valve chamber 35 has a lidded cylindrical shape. The suction port 30 corresponds to an opening of the valve chamber 35. The valve chamber 35 communicates with the suction chamber 24 through the gas passage 32.

A displacement control valve 36, which is formed by an electromagnetic valve, is installed in the rear housing member 14. A first supply passage 37 extends in the cylinder block 11 and the rear housing member 14 and thus connects the displacement control valve 36 to the crank chamber 15. A second supply passage 38 extends in the rear housing member 14 and thus connects the displacement control valve 36 to the discharge chamber 25. The displacement control valve 36 includes a non-illustrated valve mechanism. The first and second supply passages 37, 38 are connected to each other when the displacement control valve 36 is actuated (held in an open state). Further, a communication passage 39 extends in the rear housing member 14 and thus connects the displacement control valve 36 to the valve chamber 35 of the open degree adjustment valve 34. The communication passage 39 is branched from the first supply passage 37 and has an end corresponding to a bottom surface 35*a* of the valve chamber 35 of the open degree adjustment valve 34. A non-illustrated computer is connected to the displacement control valve 36 and performs an electric current supply control procedure (a duty control procedure).

A bleed passage 40 extends in the cylinder block 11 and the rear housing member 14 and thus connects the crank chamber 15 to the valve chamber 35 of the open degree adjustment valve 34. The bleed passage 40 has an end corresponding to an inner wall surface 35*b* of the valve chamber 35 of the open degree adjustment valve 34.

In the illustrated embodiment, the first and second supply passages 37, 38 define a supply line that supplies refrigerant gas from the discharge chamber 25 to the crank chamber 15. The gas passage 32, the valve chamber 35 (a first accommodation chamber S1, a second accommodation chamber S2, and a valve seat hole 45) of the open degree adjustment valve 34, and the bleed passage 40 define an outlet line that sends the refrigerant gas from the crank chamber 15 to the suction chamber 24.

Figure 2:
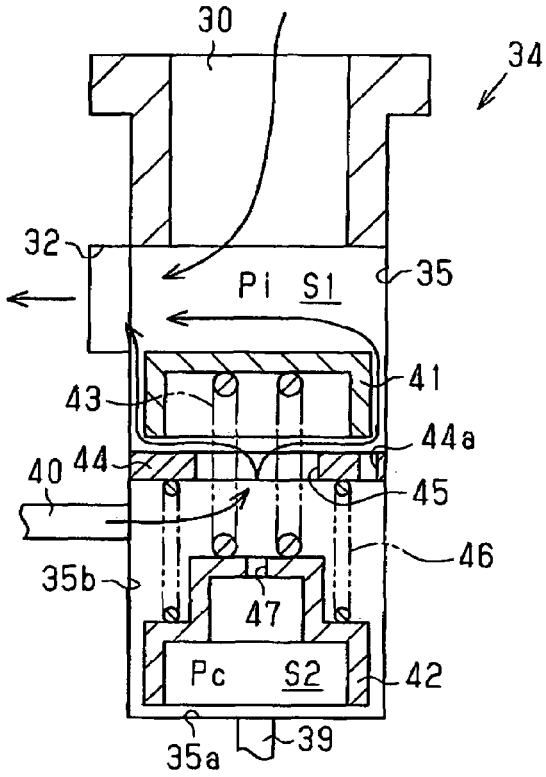
FIG. 2 is a cross-sectional view showing an open degree adjustment valve when
Figure 3:
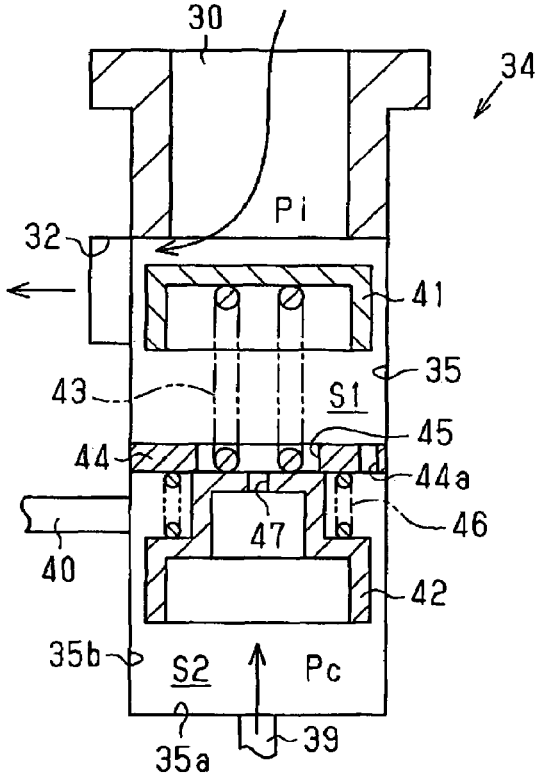
FIG. 3 is a cross-sectional view showing the open degree adjustment valve when the compressor of FIG. 1 is in a displacement varying state.

The structure of the open degree adjustment valve 34 will here after be explained in detail, referring to FIGS. 1 to 3.

The valve chamber 35 accommodates a first spool 41 and a second spool 42, each of which is formed in a lidded cylindrical shape. The first spool 41 functions as a first valve body that adjusts the open degree (the communication area) of the suction line extending from the external refrigerant circuit 33 to the suction chamber 24. The second spool 42 functions as a second valve body that adjusts the open degree (the communication area) of the outlet line. The first and second spools 41, 42 are received in the valve chamber 35 movably along the inner wall surface 35*b* (between the suction port 30 and the bottom surface 35*a*). A first spring 43 serving as a valve body joint spring is arranged between the first spool 41 and the second spool 42. The first and second spools 41, 42 are arranged in series along the movement direction of the spools 41, 42 (a direction perpendicular to a radial direction of the valve chamber 35), or the axial direction of the valve chamber 35. In the valve chamber 35, the second spool 42 is located at a side corresponding to the back of the first spool 41. The first and second spools 41, 42 are connected to each other through the first spring 43 and thus allowed to move in the axial direction of the valve chamber 35. The first and second spools 41, 42 are allowed to move independently from each other.

When the compressor 10 is operating, the first valve body 41 receives a force from the refrigerant gas introduced into the suction port 30 in a direction of opening the suction line. The first spring 43 applies a load to the first valve body 41 to oppose the force.

A clearance (a gap) is defined between an outer wall surface of each of the first and second spools 41, 42 and the inner wall surface 35*b* of the valve chamber 35. A surface of the first spool 41 faced to the suction port 30 receives a suction pressure Pi, the pressure in the suction chamber 24. A surface of the second spool 42 faced to the bottom surface 35*a* of the valve chamber 35 receives a crank chamber pressure Pc, the pressure in the crank chamber 15 (see FIGS. 2 and 3). The second spool 42 receives the crank chamber pressure Pc from the bleed passage 40 and the crank chamber pressure Pc from the communication passage 39. However, the crank chamber pressure Pc from the communication passage 39 is higher than the crank chamber pressure Pc from the bleed passage 40. The crank chamber pressure Pc from the communication passage 39 thus dominantly acts on the second spool 42.

A valve seat 44 is fixed to the wall of the valve chamber 35. The valve seat 44 divides the valve chamber 35 into the first accommodation chamber S1 that accommodates the first spool 41 and the second accommodation chamber S2 that accommodates the second spool 42. The valve seat 44 has an annular shape (a ring-like shape). The valve seat hole 45 extends through the center of the valve seat 44. The dimension (the diameter) of the valve seat hole 45 is sufficiently large for allowing the first spring 43, which is arranged between the first and second spools 41, 42, to pass through the valve seat hole 45. Further, a through hole 44*a* extends through the valve seat 44 and is located adjacent to the valve seat hole 45. The first accommodation chamber S1 communicates with the second accommodation chamber S2 through the through hole 44*a*. The position of the through hole 44*a* is selected in such a manner that the through hole 44*a* is maintained in an open state regardless of the positions, or movement, of the first and second spools 41, 42 in the valve chamber 35. Blow-by gas leaked from a clearance between the pistons 22 and the inner circumference surface of the cylinder bores 20 through the crank chamber 35 may enter the second accommodation chamber S2 of the valve chamber 35 and be removed from the second accommodation chamber S2 through the through hole 44*a*. An outer wall surface of the valve seat 44 is fixed to the inner wall surface 35*b* of the valve chamber 35 without defining a clearance (a gap) between the outer wall surface of the valve seat 44 and the inner wall surface 35*b*.

A second spring 46 serving as a valve seat joint spring is arranged between the second spool 42 and the valve seat 44. The second spring 46 urges the second spool 42 in a direction of separating from the valve seat 44. A valve hole 47 serving as a fixed orifice is provided in a portion of the second spool 42 opposed to the valve seat hole 45. The diameter of the valve hole 47 is smaller than the diameter of the valve seat hole 45.

In the open degree adjustment valve 34, which is configured as above-described, the first and second spools 41, 42 may move (retreat) toward the bottom surface 35*a* of the valve chamber 35. This enlarges a gas communication area between the suction port 30 and the gas passage 32 and a gas communication area between the bleed passage 40 and the valve seat hole 45 of the valve seat 44. The bleed passage 40 communicates with the second accommodation chamber S2 of the valve chamber 35. The movement of the first and second spools 41, 42 toward the bottom surface 35*a* of the valve chamber 35 is promoted by the gravity (the weight of each of the spools 41, 42) and the urging force of the second spring 46 functioning as assisting forces. In FIG. 2, the suction line including the suction port 30 and the gas passage 32 and the outlet line including the bleed passage 40, the valve chamber 35, and the gas passage 32 are each held in a state corresponding to a maximum open degree. In the illustrated embodiment, a direction in which the first spool 41 moves in the first accommodation chamber S1 toward the bottom surface 35*a* of the valve chamber 35 corresponds to a direction in which the first spool 41 increases the open degree of the suction line. A direction in which the second spool 42 moves in the second accommodation chamber S2 toward the bottom surface 35*a* of the valve chamber 35 corresponds to a direction in which the second spool 42 increases the open degree of the outlet line.

Alternatively, the first and second spools 41, 42 may move (advance) in the open degree adjustment valve 34 toward the suction port 30. This reduces the gas communication area between the suction port 30 and the gas passage 32 and the gas communication area between the bleed passage 40 and the valve seat hole 45 of the valve seat 44. In FIG. 3, the suction line including the suction port 30 and the gas passage 32 and the outlet line including the bleed passage 40, the valve chamber 35, and the gas passage 32 are each held in a state corresponding to a minimum open degree. In this state, the second spool 42 is held in contact with the valve seat 44. In the illustrated embodiment, a direction in which the first spool 41 moves in the first accommodation chamber S1 toward the suction port 30 corresponds to a direction in which the first spool 41 decreases the open degree of the suction line. A direction in which the second spool 42 moves in the second accommodation chamber S2 toward the suction port 30 corresponds to a direction in which the second spool 42 decreases the open degree of the outlet line. The minimum open degree of the suction line corresponds to a value restricted to an extent at which the amount of the refrigerant gas flowing through the suction line becomes sufficiently large for suppressing gas pressure variation when the compressor 10 is in a displacement varying state. The "displacement varying state" corresponds to a state of the compressor 10 in which the displacement is being varied (in a range less than the maximum displacement).

The operation of the compressor 10 of the illustrated embodiment will be explained as follows.

Through movement of each piston 21 from the top dead center to the bottom dead center, the refrigerant gas is drawn from the suction chamber 24 to the associated compression chamber 22 through the suction hole 26 and the suction valve 27. Then through movement of each piston 21 from the bottom dead center to the top dead center, the refrigerant gas is compressed to a predetermined level in the compression chamber 22. The refrigerant gas then flows from the compression chamber 22 to the discharge chamber 25 through the discharge hole 28 and the discharge valve 29.

In this state, the displacement control valve 36 is operated to control the proportion of an inlet amount of the gas to the crank chamber 15 through the first and second supply passages 37, 38 with respect to an outlet amount of the gas from the crank chamber 15 through the bleed passage 40. This determines the crank chamber pressure Pc of the crank chamber 15, or adjusts the pressure in the crank chamber 15. If the crank chamber pressure Pc changes, the difference between the pressure in the crank chamber 15 and the pressure in the cylinder bore 20 with respect to the piston 21 changes. This alters the inclination angle of the swash plate 18, adjusting the stroke of the piston 21, or the displacement of the compressor 10. In other words, if the crank chamber pressure Pc drops, the inclination angle of the swash plate 18 increases. This increases the stroke of the piston 21 and, correspondingly, the displacement of the compressor 10. In contrast, if the crank chamber pressure Pc rises, the inclination angle of the swash plate 18 decreases. This decreases the stroke of the piston 21 and the displacement of the compressor 10.

When the compressor 10 is being started, the displacement control valve 36 is maintained in a closed state. The first and second supply passages 37, 38 are thus disconnected from each other. In other words, the supply line is held in a fully closed state. In this state, the refrigerant is stopped from flowing from the discharge chamber 25 to the crank chamber 15. Further, the crank chamber pressure Pc is prevented from being supplied to the second spool 42 of the open degree adjustment valve 34.

Accordingly, in the valve chamber 35, the difference between the crank chamber pressure Pc and the suction pressure Pi is maintained at a relatively small extent. This causes the first and second spools 41, 42 to move toward the bottom surface 35*a* of the valve chamber 35 while receiving the assisting forces, the gravity (the weight of each spool 41, 42) and the urging force of the second spring 46. In other words, the first and second spools 41, 42 are switched to positions at which the spools 41, 42 maintain the suction line including the suction port 30 and the gas passage 32 and the outlet line including the bleed passage 40, the valve chamber 35, and the gas passage 32 in fully open states (see FIG. 2). That is, the open degree of each of the suction and outlet lines becomes maximum. This causes the liquid refrigerant to flow from the crank chamber 15 to the bleed passage 40, the second accommodation chamber S2, the valve seat hole 45, the first accommodation chamber S1, and the gas passage 32 in this order, as indicated by the corresponding arrows in FIG. 2. The liquid refrigerant is thus rapidly sent to (introduced into) the suction chamber 24.

When the compressor 10 is being started, the refrigerant does not flow from the discharge chamber 25 to the crank chamber 15. Further, the flow of the liquid refrigerant out of the crank chamber 15 suppresses a pressure rise in the crank chamber 15, which may be caused by evaporation of the liquid refrigerant in the crank chamber 15. In this manner, the difference between the crank chamber pressure Pc and the suction pressure Pi is minimized. The crank chamber pressure Pc thus quickly drops, increasing the inclination angle of the swash plate 18 at a corresponding speed. This maximizes the displacement of the compressor 10. The starting performance of the compressor 10 is thus maintained at a favorable level.

When the compressor 10 operates in the maximum displacement state, the displacement control valve 36 is held in a closed state. Therefore, as in the period when the compressor 10 is started, the supply passage from the discharge chamber 25 to the crank chamber 15 is held in a fully closed state. The difference between the crank chamber pressure Pc and the suction pressure Pi thus becomes relatively small. Accordingly, if the first and second spools 41, 42 are located in the vicinity of the suction port 30, the flow of the refrigerant gas from the suction port 30 to the suction chamber 24 causes the first and second spools 41, 42 to move toward the bottom surface 35*a* of the valve chamber 35. In this state, the first spool 41 is free from the load caused by the first spring 43. That is, the first spring 43 is maintained at the rest length. When the movement of the first and second spools 41, 42 is completed, the suction line including the suction port 30 and the gas passage 32 and the outlet line including the bleed passage 40, the valve chamber 35, the valve seat hole 45, and the gas passage 32 become fully open (see FIG. 2). In other words, the open degree of each of the suction and outlet lines is maximized. The compressor 10 thus operates in accordance with the maximum displacement.

When the compressor 10 is operating in the displacement varying state, the displacement control valve 36 is held in an open state. The first and second supply passages 37, 38 thus communicate with each other. The supply line extending from the discharge chamber 25 to the crank chamber 15 is thus opened at a predetermined open degree. This raises the crank chamber pressure Pc to a level higher than the suction pressure Pi. Further, when the supply line is open, the pressure in the crank chamber 15 is applied to the second spool 42 of the open degree adjustment valve 34 through the communication passage 39. Thus, if the first and second spools 41, 42 are located in the vicinity of the bottom surface 35*a* of the valve chamber 35, the difference between the suction pressure Pi and the crank chamber pressure Pc causes the first and second spools 41, 42 to move toward the suction port 30. At this stage, through the movement of the second spool 42 toward the first spool 41, the urging force of the first spring 43 is applied to the first spool 41. When the movement of the first and second spools 41, 42 toward the suction port 30 is completed, the suction line including the suction port 30 and the gas passage 32 is closed to an open degree smaller than that of the fully open state (see FIG. 3). This restricts the open degree of the suction line extending from the external refrigerant circuit 33 to the suction chamber 24 in such a manner as to sufficiently suppress the pressure variation of the refrigerant gas. In this state, the outlet line including the bleed passage 40, the valve chamber 35, and the gas passage 32 is also closed (FIG. 3).

The illustrated embodiment has the following advantages.

(1) When the compressor 10 is being started and operating at the maximum displacement, the open degree adjustment valve 34 increases the open degree of the suction line and that of the outlet line to the levels of FIG. 2. Contrastingly, in the displacement varying state of the compressor 10, the open degree adjustment valve 34 decreases the open degree of the suction line and that of the outlet line to the levels of FIG. 3. Thus, when the compressor 10 is being started, the liquid refrigerant is quickly sent from the crank chamber 15 to the suction chamber 24 through the outlet line, which is held at the increased open degree. This shortens the time needed for sufficiently increasing the displacement of the compressor 10, thus maintaining the performance of the compressor 10 in this period. Further, as has been described, the open degree of the suction line is increased in the maximum displacement state but decreased in the displacement varying state. This reliably suppresses the pressure variation of the refrigerant gas when the compressor 10 is operating in the displacement varying state.

(2) The first spool 41 is connected to the second spool 42 through the first spring 43. Thus, in the maximum displacement state of the compressor 10, the first spring 43 simply follows the movement of the first and second spools 41, 42, without extending or compressing. That is, the first and second spools 41, 42 are maintained free from the urging force of the first spring 43. The energy loss is not caused by the movement of the first and second spools 41, 42. The performance of the compressor 10 in the maximum displacement state is thus maintained. Contrastingly, when the compressor 10 is operating in the displacement varying state, the urging force of the first spring 43, which functions as the assisting force, promotes the movement of the first and second spools 41, 42. The open degree of the suction line is thus reliably restricted, and the pressure variation is sufficiently suppressed.

(3) The valve hole 47 is defined in the second spool 42. Thus, when the first and second spools 41, 42 move in such a manner as to increase the open degrees of the suction and outlet lines, the crank chamber pressure Pc acting on the second spool 42 is released through the valve hole 47. In other words, the valve hole 47 releases the pressure from the interior of the second spool 42 to the exterior. This prevents the pressure in the interior of the second spool 42 from acting on the second spool 42 as braking force. The first and second spools 41, 42 are thus allowed to move quickly and reliably.

(4) The second spool 42 is connected to the valve seat 44 through the second spring 46. Thus, when the first and second spools 41, 42 move in such a manner as to increase the open degrees of the suction and outlet lines, such movement is promoted by the urging force of the second spring 46, which functions as the assisting force. This allows the first and second spools 41, 42 to move quickly and reliably.

(5) The valve chamber 35 accommodates both of the first spool 41 that adjusts the open degree of the suction line and the second spool 42 that adjusts the open degree of the outlet line. The first and second spools 41, 42 move integrally with each other. Accordingly, compared to a case in which an open degree adjustment valve for the suction line and an open degree adjustment valve for the outlet line are arranged at separate positions not joining each other, the configuration of the compressor 10 is simplified and the size of the compressor 10 is reduced. For example, if the open degree adjustment valves for the suction and outlet lines are divided into individual valves, it is necessary to separately provide passages that supply the crank chamber pressure Pc to the valves. However, in the illustrated embodiment, the single passage is necessary for providing the crank chamber pressure Pc to the open degree adjustment valve 34. Further, in the embodiment, the first and second spools 41, 42 move integrally with each other and thus adjust the open degrees of the suction and outlet lines at one time. The open degrees of the suction and outlet lines are thus reliably adjusted to desired levels.

(6) When the compressor 10 is operating in the displacement varying state (when the crank chamber pressure Pc is relatively high), the outlet line is held in the closed state. This reduces the short-circuit amount (the leakage) of the compressed refrigerant gas that flows into the suction chamber 24. The efficiency of the refrigerant cycle is thus prevented from being decreased by re-expansion of the leaking refrigerant gas.

It should be apparent to those skilled in the art that the present invention may be embodied in many other specific forms without departing from the spirit or scope of the invention. Particularly, it should be understood that the invention may be embodied in the following forms.

In the illustrated embodiment, the open degree adjustment valve 34 is positioned upright. However, the open degree adjustment valve 34 may be positioned horizontally. In this case, the first and second spools 41, 42 are free from the gravity. Thus, when the compressor 10 is operating in the displacement varying state, the first and second spools 41, 42 are moved toward the bottom surface 35*a* of the valve chamber 35 by the urging force of the second spring 46.

In the illustrated embodiment, the valve hole 47 may be omitted.

In the illustrated embodiment, the shapes of the first and second spools 41, 42 and the shape of the valve chamber 35 may be modified as needed. For example, the first and second spools 41, 42 may have parallelepiped shapes and the valve chamber 35 may have a rectangular cross-sectional shape (as viewed in a direction perpendicular to the movement direction of the first and second spools 41, 42).

In the illustrated embodiment, the second spring 46, which connects the second spool 42 to the valve seat 44, may be omitted. In this case, in the displacement varying state of the compressor 10, the first and second spools 41, 42 may be moved simply by the weights of the spools 41, 42.

In the illustrated embodiment, when the compressor 10 operates in the maximum displacement state, the load of the first spring 43, which acts on the first spool 41, may be reduced to a level sufficient for fully opening the suction and outlet lines. In other words, as long as the suction and outlet lines are held in the fully open states, the load of the first spring 43 may be applied to the first spool 41 regardless of whether or not the length of the first spring 43 corresponds to the original size.

In the illustrated embodiment, the valve seat 44 may have multiple through holes 44*a*. In other words, the quantity of the through holes 44*a* and the diameter of each of the through holes 44*a* may be set in correspondence with the restriction amount of the open degree of each of the suction and outlet lines.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor having a piston accommodated in a cylinder bore, the piston operating to draw from a suction chamber into the cylinder bore refrigerant gas that has been introduced into the suction chamber through a suction line, the piston compressing the refrigerant gas in the cylinder bore and discharging the refrigerant gas into a discharge chamber, the refrigerant gas being allowed to flow from the discharge chamber into a crank chamber through a supply passage, and from the crank chamber into the suction chamber through an outlet line for adjusting the pressure in the crank chamber, a stroke of the piston changing in correspondence with the pressure in the crank chamber, the compressor comprising:

an open degree adjustment valve, which has a first valve body for adjusting an open degree of the suction line, a second valve body for adjusting an open degree of the outlet line, and a valve chamber accommodating the first valve body and the second valve body, wherein the first valve body and the second valve body are connected to each other movably in the valve chamber in correspondence with a pressure in the suction chamber and the pressure in the crank chamber, wherein the first valve body moves in such a manner as to increase the open degree of the suction line when the difference between the pressure in the suction chamber and the pressure in the crank chamber decreases, and reduce the open degree of the suction line when the difference between the pressure in the suction chamber and the pressure in the crank chamber increases, wherein the second valve body moves in such a manner as to increase the open degree of the outlet line when the difference between the pressure in the suction chamber and the pressure in the crank chamber decreases, and reduce the open degree of the outlet line when the difference between the pressure in the suction chamber and the pressure in the crank chamber increases, and wherein the first valve body and the second valve body are allowed to move independently from each other.

2. A variable displacement compressor having a piston accommodated in a cylinder bore, the piston operating to draw from a suction chamber into the cylinder bore refrigerant gas that has been introduced into the suction chamber through a suction line, the piston compressing the refrigerant gas in the cylinder bore and discharging the refrigerant gas into a discharge chamber, the refrigerant gas being allowed to flow from the discharge chamber into a crank chamber through a supply passage, and from the crank chamber into the suction chamber through an outlet line for adjusting the pressure in the crank chamber, a stroke of the piston changing in correspondence with the pressure in the crank chamber, the compressor comprising:

an open degree adjustment valve, which has a first valve body for adjusting an open degree of the suction line, a second valve body for adjusting an open degree of the outlet line, and a valve chamber accommodating the first valve body and the second valve body, wherein the first valve body and the second valve body are connected to each other movably in the valve chamber in correspondence with a pressure in the suction chamber and the pressure in the crank chamber, wherein the first valve body moves in such a manner as to increase the open degree of the suction line when the difference between the pressure in the suction chamber and the pressure in the crank chamber decreases, and reduce the open degree of the suction line when the difference between the pressure in the suction chamber and the pressure in the crank chamber increases, wherein the second valve body moves in such a manner as to increase the open degree of the outlet line when the difference between the pressure in the suction chamber and the pressure in the crank chamber decreases, and reduce the open degree of the outlet line when the difference between the pressure in the suction chamber and the pressure in the crank chamber increases, wherein the open degree adjustment valve includes a valve body joint spring that joins the second valve body to the first valve body, the valve body joint spring applying a load to the first valve body to oppose a force acting on the first valve body in a direction of opening the suction line, wherein, when the difference between the pressure in the suction chamber and the pressure in the crank chamber decreases, the second valve body moves in a direction of separating from the first valve body in such a manner as to reduce or substantially cancel the load of the valve body joint spring that acts on the first valve body, and wherein, when the difference between the pressure in the suction chamber and the pressure in the crank chamber increases, the second valve body moves toward the first valve body in such a manner as to allow the load of the valve body joint spring to act on the first valve body.

3. The compressor according to claim 2, wherein the first valve body receives the pressure in the suction chamber, the second valve body receives the pressure in the crank chamber, and the second valve body includes a fixed orifice.

4. The compressor according to claim 2, wherein the open degree adjustment valve includes:

a valve seat for dividing the valve chamber into a first accommodation chamber that accommodates the first valve body and a second accommodation chamber that accommodates the second valve body, the valve seat having a valve seat hole through which the valve body joint spring is allowed to pass; and a valve seat joint spring for joining the second valve body to the valve seat, the valve seat joint spring urging the second valve body in a direction of separating from the valve seat.

5. A variable displacement compressor having a piston accommodated in a cylinder bore, the piston operating to draw from a suction chamber into the cylinder bore refrigerant gas that has been introduced into the suction chamber through a suction line, the piston compressing the refrigerant gas in the cylinder bore and discharging the refrigerant gas into a discharge chamber, the refrigerant gas being allowed to flow from the discharge chamber into a crank chamber through a supply passage, and from the crank chamber into the suction chamber through an outlet line for adjusting the pressure in the crank chamber, a stroke of the piston changing in correspondence with the pressure in the crank chamber, the compressor comprising:

an open degree adjustment valve, which has a first valve body for adjusting an open degree of the suction line, a second valve body for adjusting an open degree of the outlet line, and a valve chamber accommodating the first valve body and the second valve body, wherein the first valve body and the second valve body are connected to each other movably in the valve chamber in correspondence with a pressure in the suction chamber and the pressure in the crank chamber, wherein the first valve body moves in such a manner as to increase the open degree of the suction line when the difference between the pressure in the suction chamber and the pressure in the crank chamber decreases, and reduce the open degree of the suction line when the difference between the pressure in the suction chamber and the pressure in the crank chamber increases, wherein the second valve body moves in such a manner as to increase the open degree of the outlet line when the difference between the pressure in the suction chamber and the pressure in the crank chamber decreases, and reduce the open degree of the outlet line when the difference between the pressure in the suction chamber and the pressure in the crank chamber increases, wherein the first valve body adjusts the open degree of the suction line to a fully open level when the compressor is being started and operating at a maximum displacement, and to a level smaller than the fully open level but greater than a fully closed level in a displacement varying state of the compressor, and wherein the second valve body adjusts the open degree of the outlet line to a fully open level when the compressor is being started and operating at the maximum displacement, and to a level smaller than the fully open level but greater than a fully closed level in the displacement varying state of the compressor.

* * * * *